US007735807B2

(12) United States Patent
Romo

(10) Patent No.: US 7,735,807 B2
(45) Date of Patent: Jun. 15, 2010

(54) TENSION HOLDER FOR LOAD LIFTING

(75) Inventor: David Arevalo Romo, Bonney Lake, WA (US)

(73) Assignee: SafeWorks, LLC, Tukwila, WA (US)

( * ) Notice: Subject to any disclaimer, the term of this patent is extended or adjusted under 35 U.S.C. 154(b) by 108 days.

(21) Appl. No.: 11/960,331

(22) Filed: Dec. 19, 2007

(65) Prior Publication Data

US 2009/0159734 A1 Jun. 25, 2009

(51) Int. Cl.
*B21F 9/00* (2006.01)

(52) U.S. Cl. ..... 254/251; 254/256; 182/112; 182/150; 182/145

(58) Field of Classification Search ..... 254/250, 254/251, 252, 253, 256, 257, 258; 182/112, 182/150, 142, 145, 146
See application file for complete search history.

(56) References Cited

U.S. PATENT DOCUMENTS

| | | | | | |
|---|---|---|---|---|---|
| 414,669 | A * | 11/1889 | Baldwin | 83/411.7 |
| 560,708 | A * | 5/1896 | Gorris | 24/134 R |
| 2,272,494 | A * | 2/1942 | Winslow | 24/134 R |
| 3,824,653 | A * | 7/1974 | Sholler | 24/134 KB |
| 4,181,194 | A * | 1/1980 | Bassett et al. | 182/112 |
| 4,254,941 | A * | 3/1981 | Tanson | 254/267 |
| 4,462,626 | A * | 7/1984 | Heidemann | 294/114 |
| 4,928,925 | A | 5/1990 | Christison | |
| 5,660,372 | A * | 8/1997 | Bobel | 254/15 |
| 5,857,737 | A * | 1/1999 | Fraser | 269/236 |
| 6,019,352 | A * | 2/2000 | Mayer | 254/248 |
| 6,619,964 | B2 * | 9/2003 | Geltsch et al. | 439/67 |
| 2002/0192999 | A1 * | 12/2002 | Geltsch et al. | 439/498 |
| 2007/0272906 | A1 | 11/2007 | Davidson | |
| 2007/0298696 | A1 * | 12/2007 | Blatz | 451/358 |

FOREIGN PATENT DOCUMENTS

| | | |
|---|---|---|
| JP | 06/329392 | 11/1994 |
| JP | 09/249387 | 9/1997 |

* cited by examiner

*Primary Examiner*—Emmanuel M Marcelo
(74) *Attorney, Agent, or Firm*—Woodcock Washburn LLP

(57) ABSTRACT

A rigging, operable to raise and lower the platform, passes through a restraint device comprising a tension holder. The tension holder comprises a first body having a substantially planar face surface and a rear portion having a divot disposed therein. A second body, substantially similar to the first body; and having a substantially planar face surface; is disposed in a substantially facing arrangement with the first body to permit a line to pass between the substantially planar face surfaces. A lever is disposed in the divot of the first body and is operable to draw together the substantially planar face of the first body and the substantially planar face of the second body whereby friction can be selectively applied to the line when the line is disposed between the substantially planar first surface and said substantially planar second surface.

20 Claims, 6 Drawing Sheets

TENSION HOLDER FOR LOAD LIFTING

BACKGROUND

Tension holders are used in a variety of load-lifting applications such as elevated platforms for building maintenance. Such platforms can be used in conjunction with a motorized hoisting device, whereby the hoisting device is attached to the platform of an elevated platform or basket that may then be raised or lowered using the hoisting device. The hoisting device and associated rigging typically comprises a tension holder, whereby a continuous lines such as a cable or rope passes through the tension holder. The tension holder is used to keep tension on the line when it would otherwise be slack.

A tension holder may also be associated with a fairlead, which is a device such as a ring or a block that has a guide opening, typically used to guide a rigging such as a line, such as wire or nylon rope or other cable, around an object, or to stop the rigging from moving laterally.

A tension holder is used in a variety of applications in which riggings are used, including marine vehicles, loading devices, and various hoisting applications such as elevated platforms for building maintenance. A tension holder is typically used on a suspended scaffold work basket or platform to keep tension on the line whenever the unit is not suspend in the air and line has the capability to go slack. In a hoisting application, an elevated platform or basket is typically raised or lowered using a powered hoisting device attached to the platform. The hoisting device utilizes a cable that is guided through a fairlead and then through a tension holder. A tension holder has a wear surface that conforms to the diameter of a line to keep tension on the line. It is used to keep the line taught and in place and also to prevent the lines from entangling with other items or themselves.

Prior art tension holders are made up of a number of parts including rollers with bearings which increase assembly and service time.

SUMMARY OF THE INVENTION

In one embodiment, a platform has a hoisting machine mounted thereon. A rigging, operable to raise and lower the platform, passes through a restraint device comprising a tension holder. The tension holder comprising a first body having a substantially planar face surface and a rear portion having a divot disposed therein. A second body, substantially similar to the first body; and having a substantially planar face surface; is disposed in a substantially facing arrangement with the first to permit a line to pass between the substantially planar face surfaces. A lever is disposed in the divot of the first body and is operable to draw together the substantially planar face of the first body and the substantially planar face of the second body whereby friction can be selectively applied to the line when the line is disposed between the substantially planar first surface and said substantially planar second surface.

BRIEF DESCRIPTION OF THE DRAWINGS

The foregoing summary, as well as the following detailed description of preferred embodiments, is better understood when read in conjunction with the appended drawings. For the purposes of illustration, there is shown in the drawings exemplary embodiments; however, the present disclosure is not limited to the specific methods and instrumentalities disclosed. In the drawings.

DETAILED DESCRIPTION

Figure 1:
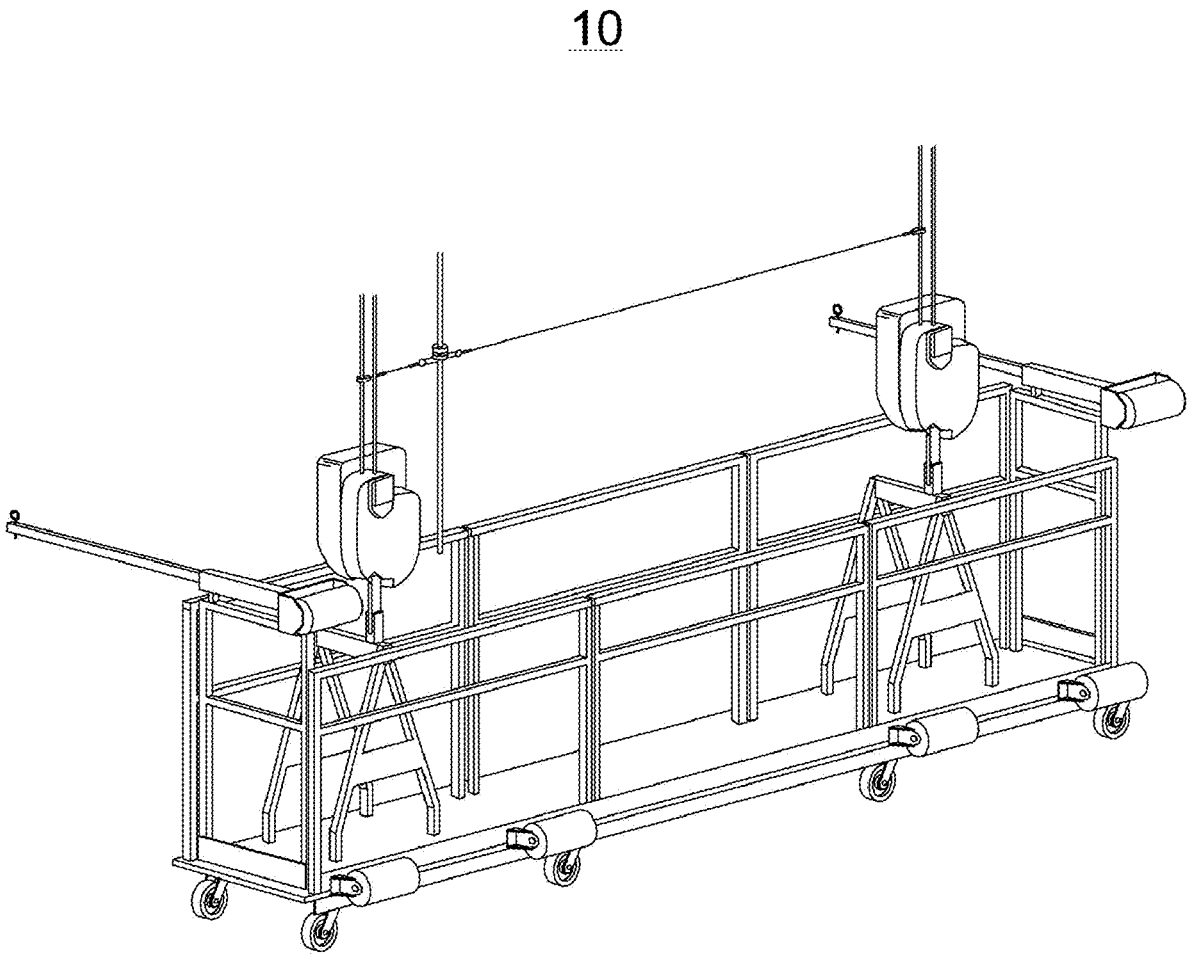
FIG. 1 is a diagram illustrating an example apparatus in which aspects of the described embodiments may be incorporated.

It is to be understood that the embodiments disclosed herein are not limited in application to the details of construction and the arrangement of components set forth in the following description or illustrated in the drawings. The disclosure is capable of other embodiments and of being practiced or being carried out in various ways. Also, it is to be understood that the phraseology and terminology used herein is for the purpose of description and should not be regarded as limiting.

The tension holder described herein reduces parts, reduces service and improves production performance. The tension holder incorporates a wear resistant material which is made as two identical halves reducing parts on hand. There are no rollers with bearings to reduce wear, which increase assembly and service time.

The tension holder assembly may be used in conjunction with hoisting devices that are used to elevate platforms or baskets typically associated with large structure service and maintenance, such at buildings, bridges, towers, and the like. FIG. 1 depicts an example platform apparatus 10 for supporting at least one person and associated work equipment. As shown in the figure, a platform 20 can be a flat surface, scaffolding, basket or cabin. The platform is of sufficient size to carry at least one worker and work equipment. In some embodiments, the platform 20 can support a plurality of workers. The platform is typically coupled to at least one powered hoisting device 30 such that the platform can be elevated or lowered in the vertical dimension. A hoist is a device used for lifting or lowering a load by means of a drum or lift-wheel around which a line wraps. The platform may be further secured with safety lines and guidelines. When maintaining or constructing structures of various kinds, a platform apparatus of this kind provides transport of personnel and materials to and from the various landings of the structure. For example, the platform may be able to move vertically along stacked mast tower sections. The platform apparatus may also be used for work on various elevated areas of the structure. Such a platform is commonly used on large scale construction projects, such as high-rise buildings and other large structures. A platform such as that described may carry personnel and materials quickly between the ground and higher floors, or between upper floors or act as a platform for working on the curtain wall or other structures of the building.

Figure 2:
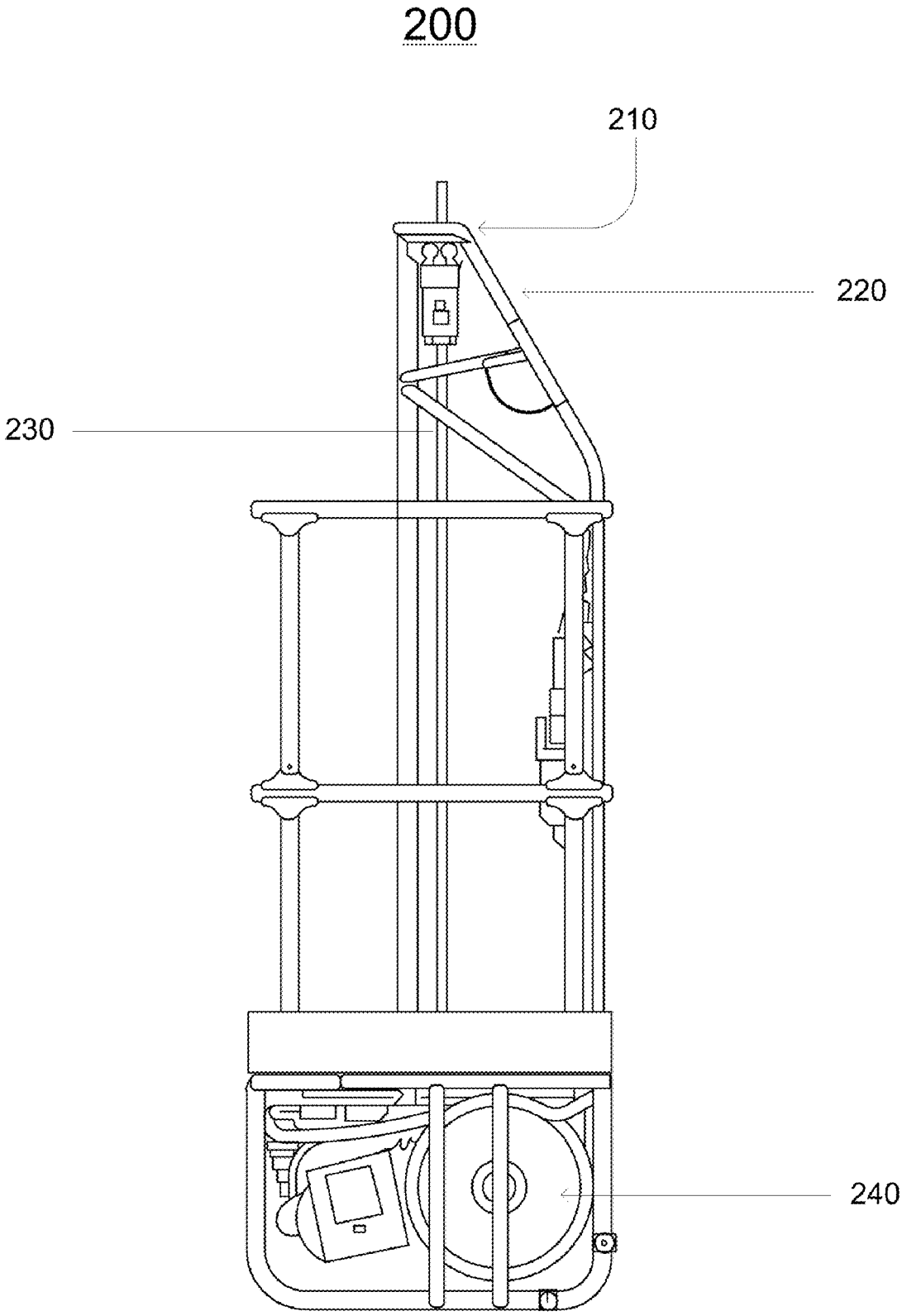
FIG. 2 is a diagram illustrating an embodiment of a hoisting device.

FIG. 2 depicts another example of a hoisting device 200 that may be used to elevate a platform or basket. The hoist may be manually operated, electrically or pneumatically driven and may use chain, fiber or other types of line as its lifting medium. The powered type hoist can be either electric motor or air motor. A hoist can be built as one integrated package unit or it can be built as a built-up custom unit. In this example, a drum hoist 240 is used that is located under the platform.

Line 230 may be securely attached to the top of the structure to be traversed. Line 230 is further guided at the top of the hoisting device 200 by a restraint assembly 210. Such a restraint assembly guides the line 230 from the drum 240 to the top of the platform by preventing the line or cable from moving laterally and otherwise prevent the line or cable from snagging. The restraint assembly 230 also prevents the line 230 from vibrating or rubbing on other surfaces.

Figure 3:
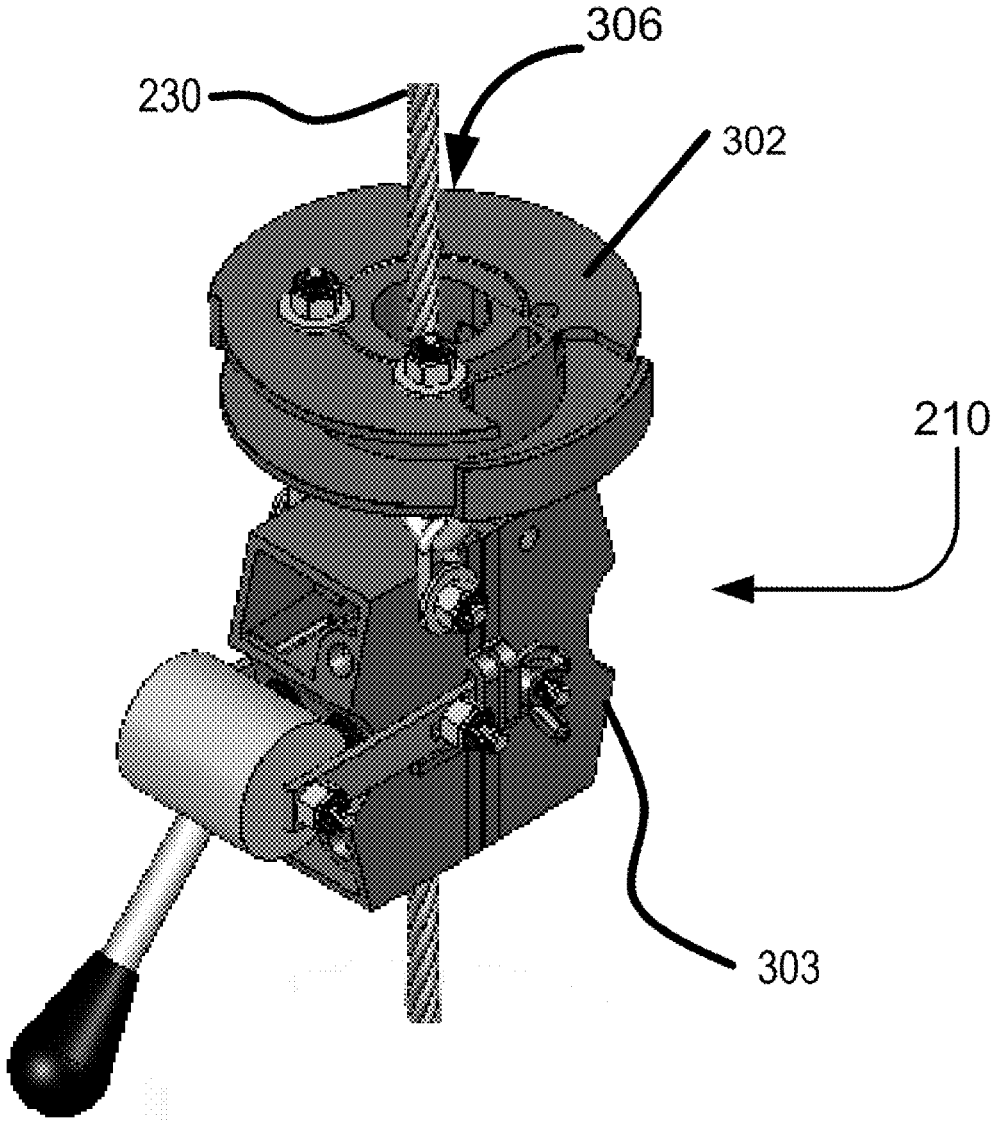
FIG. 3 is an isometric diagram illustrating a restraint assembly for use in a hoisting device and incorporating aspects of the present invention.

As illustrated in FIG. 3, restraint device 210 typically comprises a fairlead 302, which is a member such as a ring or a block that has a guide opening, and a tension holder. The tension holder, as described more fully herein is a device that keeps tension in the line 230 when the hoisting device 200 is in a position that would cause the line 230 to go slack. The restraint assembly 210 operates to restrain movement of a line 230 passing through an opening 306 of the restraint assembly. The line 230 may be any type of rigging operable to elevate or lower a platform to be controlled by the hoisting device, and is typically a wire, rope or cable.

Figure 4:
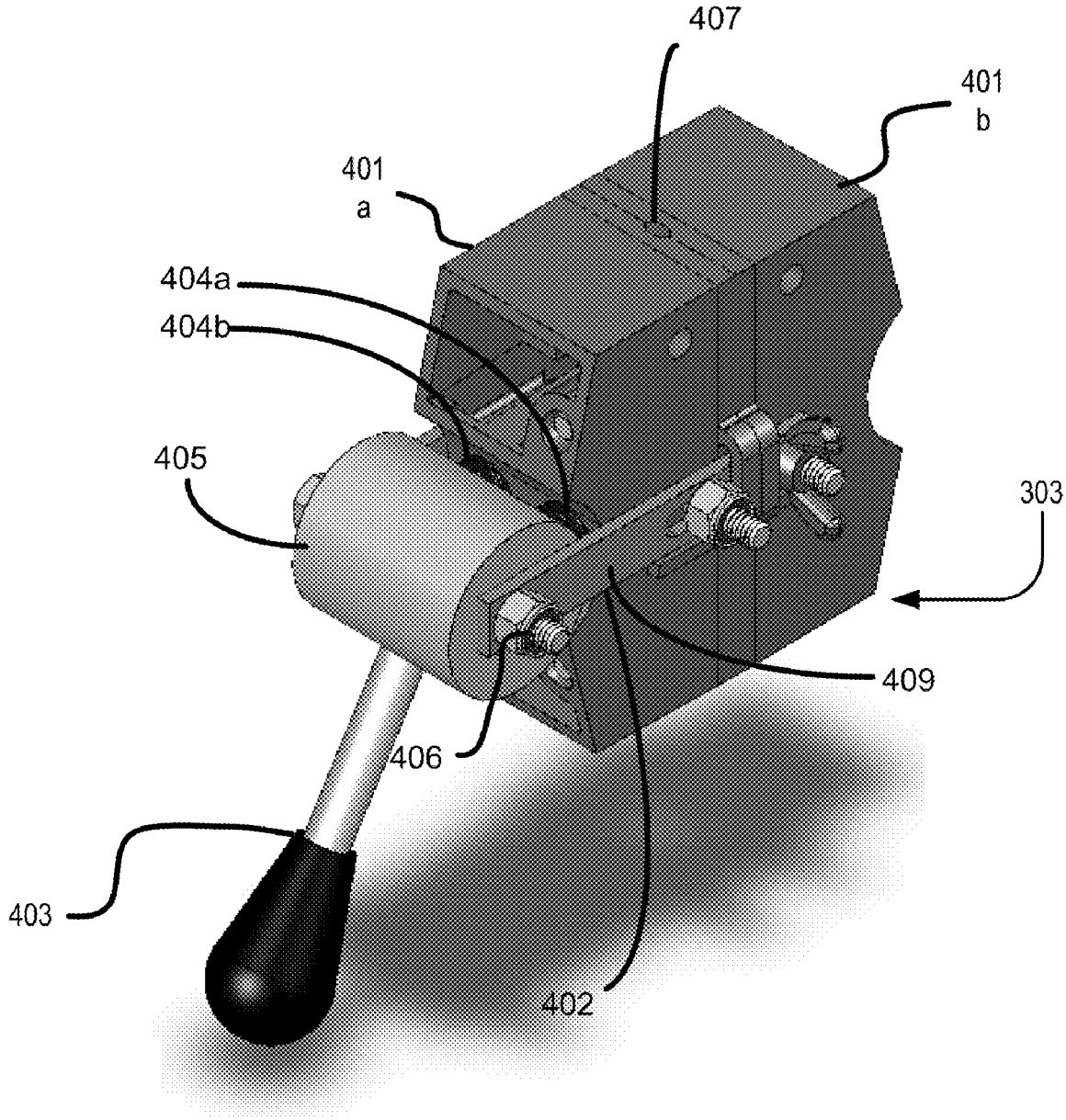
FIG. 4 is an isometric diagram of a tension holder that may be incorporated into a restraint assembly and incorporating aspects of the present invention.

An embodiment of tension holder 303 is further illustrated in FIG. 4. The tension holder comprises substantially identical bodies 401*a* and 401*b*. When the tension holder 303 is closed, as shown, a line (e.g., 230 not shown) is clamped when passing between bodies 401*a* and 401*b* via the opening 407 formed by opposing grooves in the bodies 401*a* and 401*b*. The clamping of the line between the two bodies 401*a* and 401*b*, prevents the line from moving and acts to keep a certain amount of tension in the line, preventing it from going slack. A slack line could bunch up on the platform and become entangled on itself or other objects.

The clamping occurs when the bodies 401*a* and 401*b* are drawn together by a combination of hardware. In particular, a cylinder 405 is placed proximate a divot 402 that transverses body 401(*a*). Strap 409 is secured at one end to body 401*b* and at another end to cylinder 405. Strap 409 thereby secures the cylinder 405 to the tension holder assembly. A lever 403 is attached to cylinder 405 to provide a rotational moment about an axis 406 when the lever is manually rotated. Rotating the lever 403 upwardly causes the cylinder 405 to rotate in a clockwise direction. Rotating the lever 403 downwardly causes the cylinder to rotate in a counter clockwise direction. The counter-clockwise rotation causes the tension assembly to clamp shut on the line (e.g., 230).

Spring loaded pins 404*a* and 404*b* are disposed between the cylinder and the body 401*a*. The spring loaded pins transfer the rotational force of the cylinder into a pressing force against body 401*a*. In particular, the rotation of the cylinder 405 forces the spring loaded pins 404*a*, 404*b* against body 401*a* thereby clamping the bodies 401*a*, 401*b* together about a line (e.g., 230).

Figure 5:
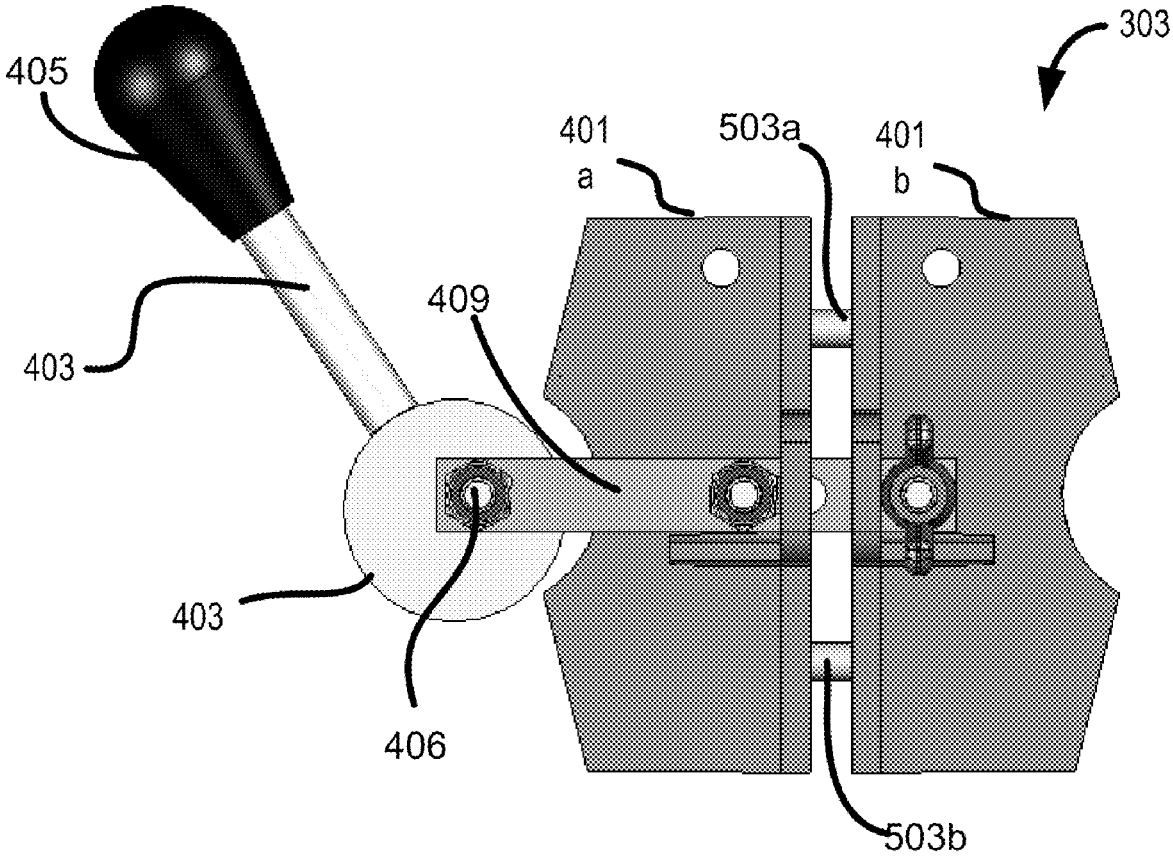
FIG. 5 is a side view diagram of the tension holder of FIG. 5 that may be incorporated into a restraint assembly and incorporating aspects of the present invention.

FIG. 5 further illustrates aspects of tension holder 303. Here, tension holder 303 is illustrated from a side view in the open position. Lever 405 is rotated upwardly, releasing spring loaded pins (not shown) and allowing bodies 401*a* and 401*b* to separate. This view also illustrates that cylinder 403 rotates about an eccentric axis 406. When the bodies 401*a* and 401*b* are separated, the clamping force is removed from the line (e.g., 230) allowing the line freedom of travel through the restraint assembly 210. FIG. 5 further illustrates the use of guide pins 503*a* and 503*b*. The guide pins are attached to one body, e.g. 401*a* and travel through bore holes (not shown) in the opposing body, e.g., 401*b*. Preferably there are two guide pins e.g., 503*a* and 503*b* per each body 401*a* and 401*b* for a total of four guide pins.

Figure 6A:
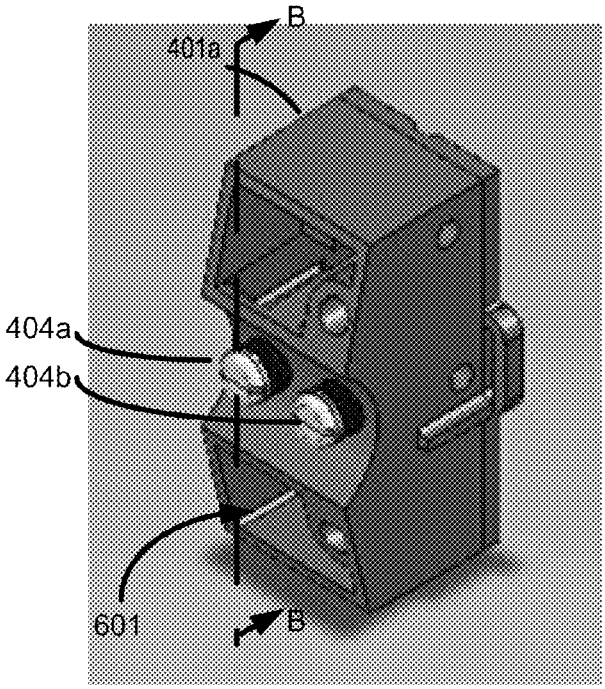
FIG. 6A is an isometric diagram illustrating a body subassembly that may incorporated into the tension holder of FIGS. 4 and 5.
Figure 6C:
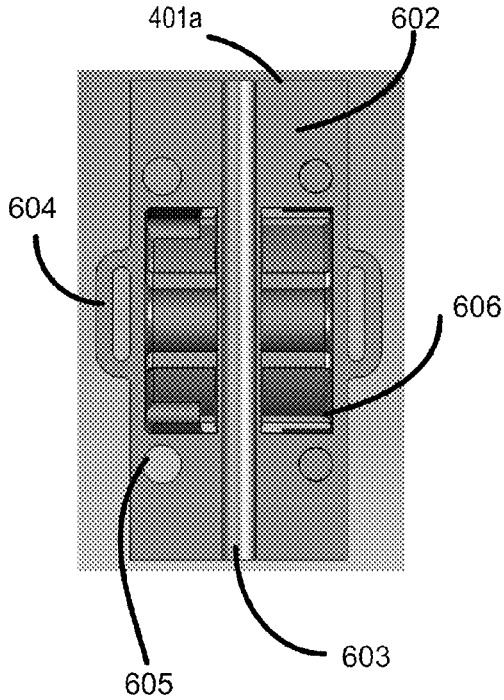
FIG. 6C is a face view diagram illustrating the body subassembly of FIG. 6A that may incorporated into the tension holder of FIGS. 4 and 5.
Figure 6B:
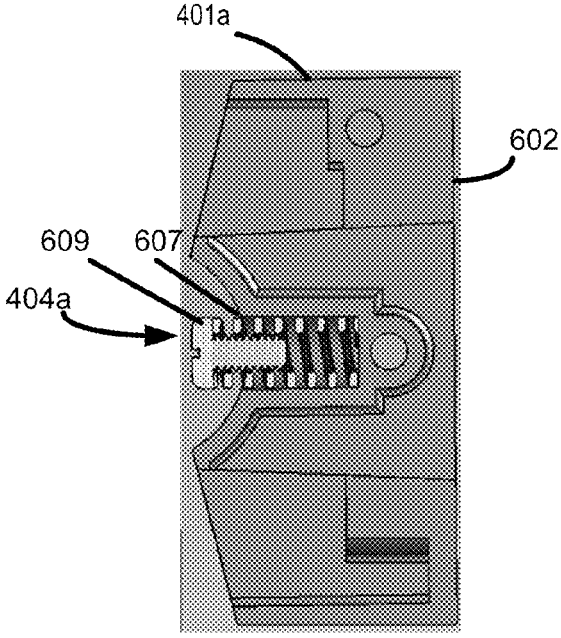
FIG. 6B is a cut-away side view diagram illustrating the body subassembly of FIG. 6A that may incorporated into the tension holder of FIGS. 4 and 5.

FIGS. 6A through 6C, further illustrate the subassembly comprising the body 401*a* and spring loaded pin(s) 404*a*. As shown in the figures, body 401*a* has substantially hollow openings 601 and has ears 604 on either side of the body. Body 401*a* is preferably made of nylon and more preferably made of Nylatron GSM®. Nylatron GSM® is a cast, partially cross-linked, Nylon 6 material modified by a molybdenum disulphide additive. Nylatron GSM® has suitable wear resistance, self-lubrication and low friction characteristics.

FIG. 6B illustrates a cutaway view of body subassembly along the line B-B of FIG. 6A. The cutaway portion illustrates spring loaded pin assembly 404*a* protruding into a bore in the body 401*a*. The spring loaded pin assembly comprises a spring 607 and a screw 609 where the shaft of the screw protrudes into the coil of the spring 607. As such, when the cylinder 405 (FIG. 4) rotates about its eccentric axis, it force the screw 609 to compress spring 607 to thereby clamp the two bodies 401*a* and 401*b* together.

FIG. 6C further illustrates aspects of the body 401*a*. Body 401*a* has a substantially planar face 602 such that the two bodies 401*a* and 401*b* can clamp together in facing relation. A groove 603 runs lengthwise along proximately the center of the substantially planar face 602. The groove 603 provides a channel through which a line is guided or allows the tension holder to stayed substantially aligned with the line (e.g., 230). Ears 604 extend from either side of body 401*a*. The ears make assembly easier and provide a guide for straps 409. Bore holes 605 provide a alignment of the bodies 401*a* and 401*b* during opening and closing. Bore holes 605 accept guide pins e.g., 503*a*, 503*b* (FIG. 5).

A further feature of the embodiment described above is that tension holder assembly comprised of two bodies 401*a* and 401*b* and is designed such that the bodies are substantially similar. As such it provides for ease of manufacturability and a reduction of parts required. The same part may be used for both bodies 401*a* and 401*b*.

The various embodiments of the fairlead may be composed of appropriate materials that provide durability, resilience, abrasion resistance and strength. For example, thermoplastic polymers such as nylon and its various embodiments such as Nylatron may be used and can be fabricated using a single injection mold. In other embodiments other types of polymers can be used. However, the materials that may be used to fabricate the disclosure described herein are not limited to polymers. The present disclosure contemplates the use of various materials such as metal, plastic, or wood as may be useful for various applications and embodiments.

It will be understood that each of the elements described above, or two or more together may also find a useful application in other types of methods differing from the type described above. Although the more detailed examples provided above relate to traction sheaves in hoisting devices associated with elevated platforms for building maintenance, it should be apparent to one of ordinary skill in the art that the apparatus and methods described herein will find application to other systems that utilize traction sheaves. Additionally, the foregoing description has set forth various embodiments of the apparatus and methods via the use of diagrams and examples. While the present disclosure has been described in connection with the preferred embodiments of the various figures, it is to be understood that other similar embodiments may be used or modifications and additions may be made to the described embodiment for performing the same function of the present disclosure without deviating there from. Furthermore, it should be emphasized that a variety of applications, including marine and transportation systems, are herein contemplated. Therefore, the present disclosure should not be limited to any single embodiment, but rather construed in breadth and scope in accordance with the appended claims. Additional features of this disclosure are set forth in the following claims.

What is claimed:

1. An apparatus comprising:

a platform;

a hoisting machine mounted on the platform;

a rigging operable to raise and lower the platform, said rigging passing through a restraint device comprising a first body having a substantially planar face surface and a rear portion having a divot disposed therein; a second body, substantially similar to the first body, and having a substantially planar face surface; said first body and said second body disposed in a substantially facing arrangement to permit a line to pass between said substantially planar face surfaces; and a lever disposed in the divot of said first body and operable to draw together the substantially planar face of the first body and the substantially planar face of the second body whereby friction can be selectively applied to said line when said lines is disposed between said substantially planar first surface and said substantially planar second surface.

2. The apparatus as recited in claim 1 wherein said rigging comprises one of: rope, cable or chain.

3. The apparatus as recited in claim 1 wherein the platform comprises one of a scaffolding, basket, or cabin.

4. The apparatus as recited in claim 1 wherein said first body comprises a groove wherein said line may be arranged.

5. The apparatus as recited in claim 4 wherein said substantially planar face surface is substantially rectangular and wherein said groove is formed in a longitudinal direction.

6. The apparatus as recited in claim 1 wherein the first and second bodies are manufactured in an extrusion process.

7. The tension apparatus as recited in claim 1 wherein the lever comprises a base portion; said base portion having a substantially cylindrical shape wherein said base portion is operable to rotate in said divot when a force is applied to said lever.

8. The tension apparatus as recited in claim 7 wherein said base portion rotates about an eccentric axis.

9. A lift tension apparatus, comprising:

a first body having a substantially planar face surface and a rear portion having a divot disposed therein;

a second body, substantially similar to the first body; and having a substantially planar face surface; said first body and said second body disposed in a substantially facing arrangement to permit a line to pass between said substantially planar face surfaces;

a lever disposed in the divot of said first body and operable to draw together the substantially planar face of the first body and the substantially planar face of the second body whereby friction can be selectively applied to said line when said lines is disposed between said substantially planar first surface and said substantially planar second surface; and a connection point for connecting the apparatus to a platform, wherein the first and second bodies are operable to hold the platform in a stationary position relative to the line when drawn together.

10. The tension apparatus as recited in claim 9 wherein said first and second bodies are manufactured as the same part.

11. The tension apparatus as recited in claim 10 wherein the first and second bodies are manufactured in an extrusion process.

12. The tension apparatus as recited in claim 9 comprising at least one piston in mechanical communication with the lever, said piston adapted to provide a force against the first body to draw together the first and second bodies.

13. The tension apparatus as recited in claim 9 wherein said first body comprises a groove wherein said line may be arranged.

14. The tension apparatus as recited in claim 13 wherein said substantially planar face surface is substantially rectangular and wherein said groove is formed in a longitudinal direction.

15. The tension apparatus as recited in claim 9 wherein the lever comprises a base portion; said base portion having a substantially cylindrical shape wherein said base portion is operable to rotate in said divot when a force is applied to said lever.

16. The tension apparatus as recited in claim 15 wherein said base portion rotates about an eccentric axis.

17. The tension apparatus as recited in claim 9 wherein said first body comprises nylon.

18. A tension apparatus, comprising:

a first body having a substantially planar face surface and a rear portion having a divot disposed therein;

a second body, substantially similar to the first body; and having a substantially planar face surface; said first body and said second body disposed in a substantially facing arrangement to permit a line to pass between said substantially planar face surfaces;

a lever disposed in the divot of said first body and operable to draw together the substantially planar face of the first body and the substantially planar face of the second body whereby friction can be selectively applied to said line when said lines is disposed between said substantially planar first surface and said substantially planar second surface said substantially planar face surface is substantially rectangular and wherein said groove is formed in a longitudinal direction; and a connection point for connecting the apparatus to a platform, wherein the first and second bodies are operable to hold the platform in a stationary position relative to the line when drawn together.

19. The tension apparatus as recited in claim 18 wherein said first body comprises nylon.

20. The tension apparatus as recited in claim 18 wherein said second body comprises guide holes into which guide pins attached to said first body protrude.

* * * * *